US008556206B2

(12) United States Patent
Eckert

(10) Patent No.: US 8,556,206 B2
(45) Date of Patent: Oct. 15, 2013

(54) FOLDED CORE FOR CARPETING

(75) Inventor: Didier Eckert, Buhl (FR)

(73) Assignee: Sonoco Development, Inc., Hartsville, SC (US)

( * ) Notice: Subject to any disclaimer, the term of this patent is extended or adjusted under 35 U.S.C. 154(b) by 288 days.

(21) Appl. No.: 13/098,885

(22) Filed: May 2, 2011

(65) Prior Publication Data

US 2012/0228422 A1 Sep. 13, 2012

(30) Foreign Application Priority Data

Mar. 11, 2011 (EP) ..... 11305272

(51) Int. Cl.
*B65H 75/08* (2006.01)

(52) U.S. Cl.
USPC ..... 242/613.1; 242/610.3

(58) Field of Classification Search
USPC ..... 242/579, 587, 587.2, 609, 610.3, 613.1
See application file for complete search history.

(56) References Cited

U.S. PATENT DOCUMENTS

| | | | | |
|---|---|---|---|---|
| 2,585,226 | A | 3/1946 | Christman | |
| 2,659,543 | A | 11/1953 | Guyer | |
| 3,194,275 | A | 7/1965 | Biggs et al. | |
| 3,471,350 | A | 10/1969 | O'Berry et al. | |
| 5,100,076 | A | 3/1992 | Cobane et al. | |
| 6,719,242 | B2 | 4/2004 | Floyd, Jr. et al. | |
| 7,562,841 | B2 | 7/2009 | Holden et al. | |
| 7,712,700 | B2 * | 5/2010 | McFarland et al. | 242/613.2 |
| 2002/0195516 | A1 | 12/2002 | Howden et al. | |
| 2005/0258299 | A1 | 11/2005 | Burchett et al. | |
| 2009/0054219 | A1 | 2/2009 | Wu | |
| 2009/0087600 | A1 | 4/2009 | McFarland et al. | |

FOREIGN PATENT DOCUMENTS

| | | | |
|---|---|---|---|
| DE | 2723373 | A1 | 12/1977 |
| EP | 2067731 | A2 | 6/2009 |
| FR | 355469 | A | 11/1905 |
| FR | 1453686 | A | 6/1966 |

* cited by examiner

*Primary Examiner* — Sang Kim
(74) *Attorney, Agent, or Firm* — Miller, Matthias & Hull LLP

(57) ABSTRACT

A core for winding floor covering material, the core being a hollow, wound paper tube having an integrally formed longitudinally oriented indentation configured to accommodate the starting edge of the floor covering material. The core eliminates the longitudinal crease often found on the final few square meters of floor covering wound around a conventional core.

4 Claims, 4 Drawing Sheets

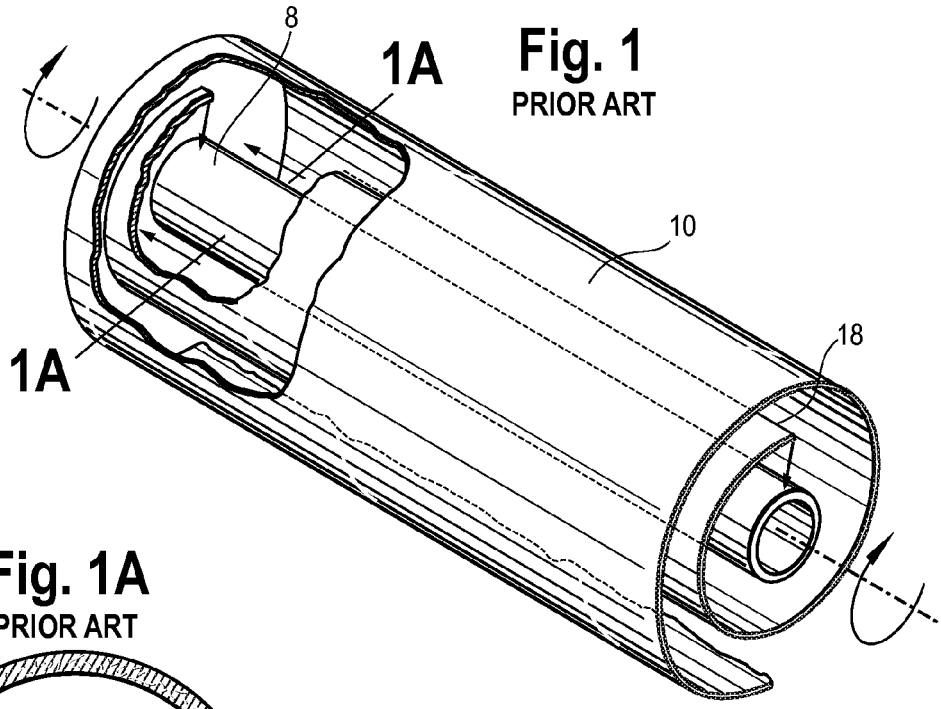
Fig. 1
PRIOR ART
Fig. 1A
PRIOR ART
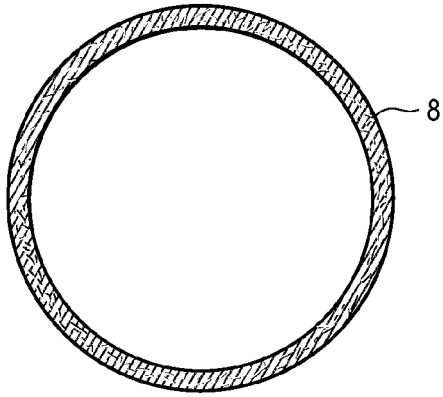
Fig. 2
PRIOR ART
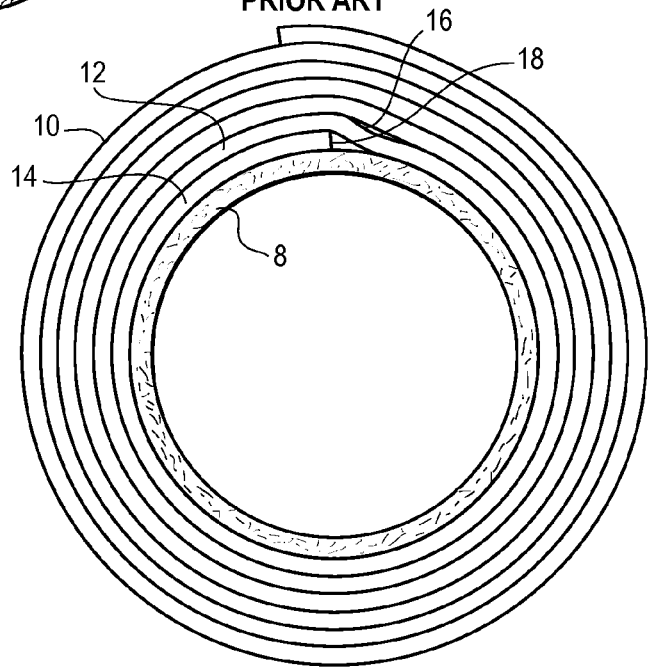

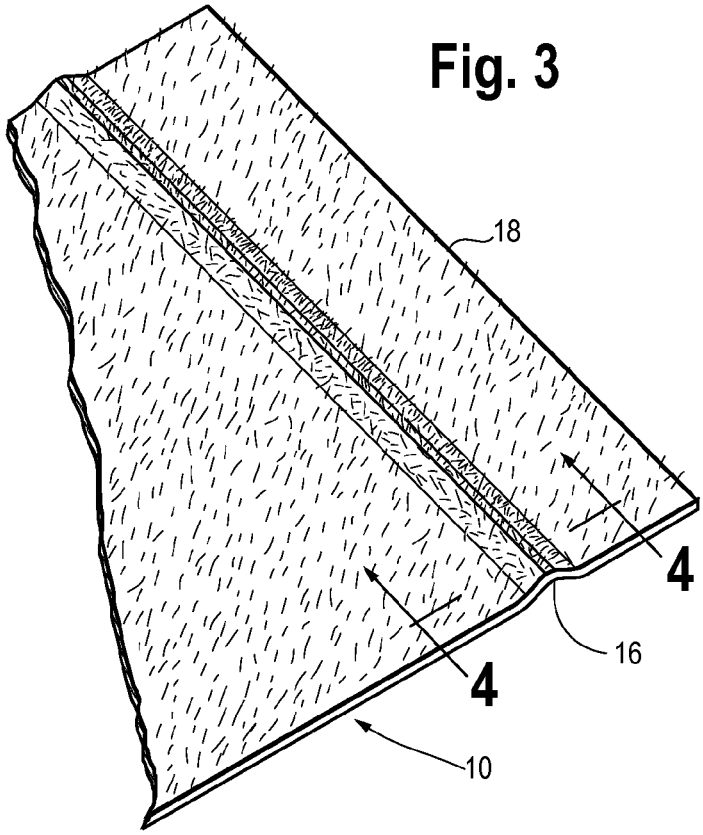
Fig. 3
Fig. 4
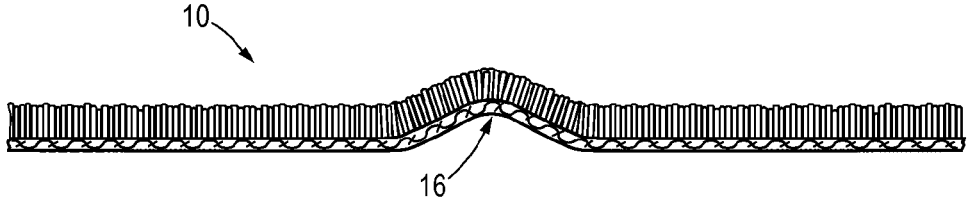

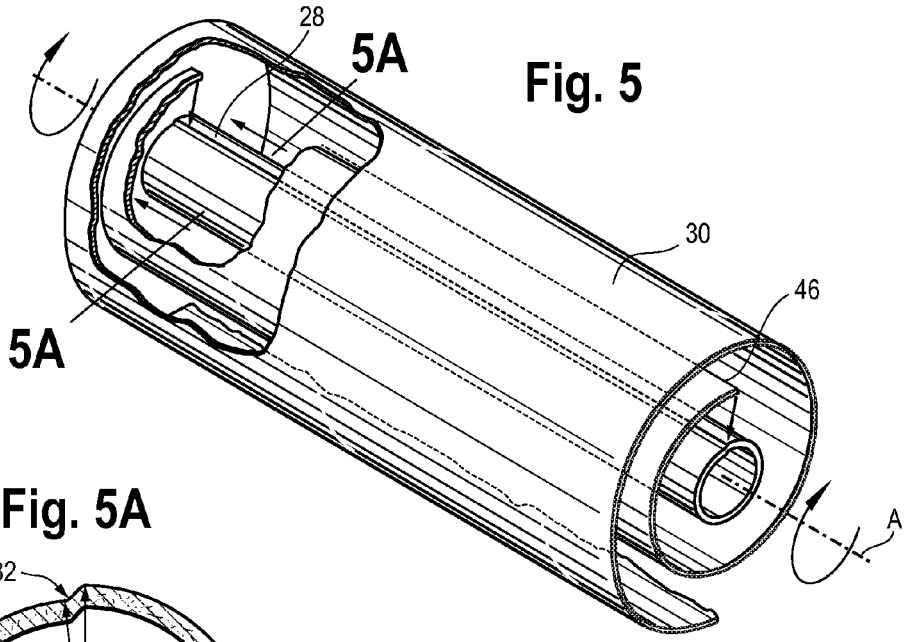
Fig. 5
Fig. 5A
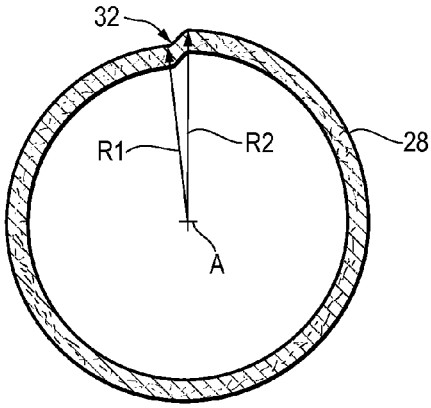
Fig. 6
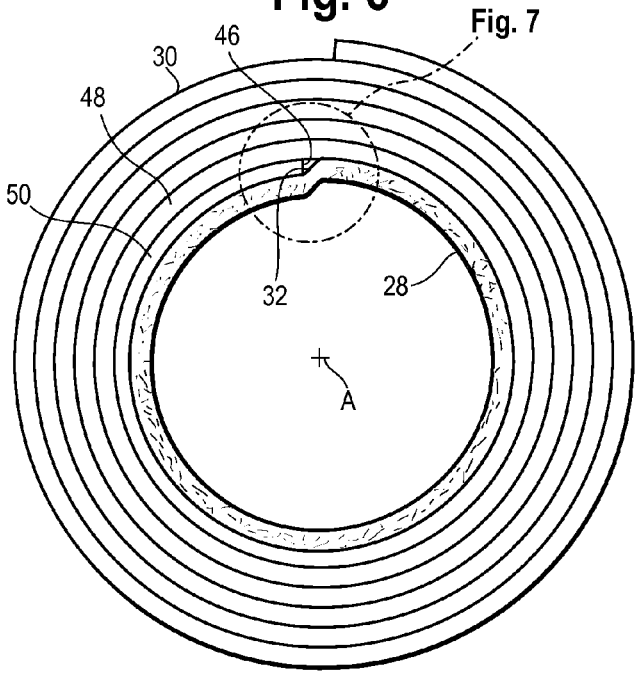

FOLDED CORE FOR CARPETING

BACKGROUND OF THE INVENTION

1. Field of the Invention

This invention patent relates to a core for winding sheet material. More particularly, this invention relates to a core for winding floor coverings such as carpeting that prevents creasing of the floor covering.

2. Description of the Related Art

Carpet and other types of floor coverings often are carried on a tube or core prior to sale. When carried in this fashion the overlap of the second layer onto the first layer (nearest the core) can create an undesirable crease or mark on the floor covering where the second layer overlaps the starting edge of the first layer.

One current solution to this problem is to grind a step-like indentation in the core where the starting edge of the floor covering can be laid so that the starting edge is flush with the unground portion (step) of the core and the second layer lays smoothly over the first layer. A disadvantage of this solution is that grinding a core is not an easy job. It requires machining, a process that creates a lot of dust. Also, where the floor covering is thick and a large indentation is needed, the core itself must have a large wall thickness, thus requiring more material for the core.

Therefore it is an object of the present invention to provide a core for use in the carpeting industry that eliminates the undesirable crease that can occur with conventional cores and does not require grinding of the core.

Another object of the invention is to provide a core having a smaller wall thickness that can be used to carry thick floor coverings and still prevent creases in the floor covering.

Further and additional objects will appear from the description, accompanying drawings, and appended claims.

BRIEF SUMMARY OF THE INVENTION

The present invention is a core for winding carpet or other floor covering material thereon. The core comprises a hollow wound paper tube having a length and a central axis. The tube is asymmetrical about the central axis and comprises a longitudinally oriented indentation or depression extending the length of the tube. The indentation has a longitudinally oriented, generally concave shape adapted to accommodate the starting edge of the floor covering material.

When a carpet or other floor covering is carried on the core, the overlap of the second layer of floor covering onto the first layer (i.e., the layer nearest the core) is relatively smooth. As a result, there is no undesirable crease or mark on the floor covering where the second layer overlaps the starting edge of the first layer.

The core may be made according to the following steps: convolutely or spirally winding paper about a cylindrical mandrel to create a hollow tube; removing the hollow tube from the mandrel; and forming in the hollow tube a longitudinally oriented indentation extending uniformly along the length of the hollow tube, the indentation having a longitudinally oriented generally concave shape adapted to accommodate the starting edge of the carpet material.

BRIEF DESCRIPTION OF THE DRAWINGS

FIG. 1 is an exploded perspective view of a prior art core shown with a section of wound carpet.

FIG. 1A is a side elevational view of the prior art core of FIG. 1.

FIG. 2 is a side elevational view of the wound carpet and prior art core of FIG. 1.

FIG. 3 is a perspective view of a section of the carpet of FIG. 1 shown laid flat.

FIG. 4 is a cross sectional elevational view of the carpet of FIG. 3 taken along line 4-4.

FIG. 5 is an exploded perspective view of a core according to the present invention shown with a section of wound carpet.

FIG. 5A is a side elevational view of the core of FIG. 5.

FIG. 6 is a side elevational view of the wound carpet and core of FIG. 5.

DETAILED DESCRIPTION OF THE INVENTION

Figure 7:
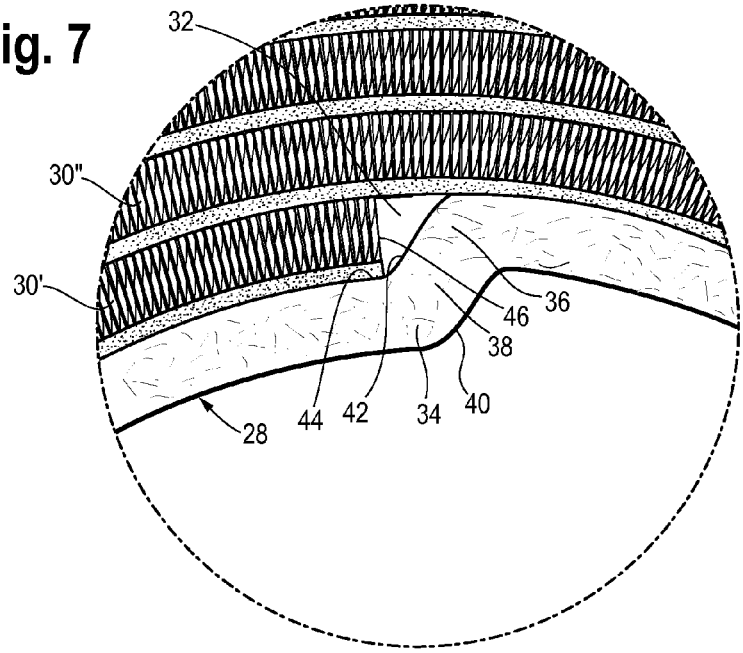
FIG. 7 is an enlarged view of a portion of the wound carpet and core of FIG. 6.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments. For example, while the drawings show, and the following detailed description refers to, a core for carrying carpet, it should be understood that the core can be used to carry other kinds of floor covering materials and, indeed, other sheet-like materials.

PRIOR ART

Turning to the drawings, there is shown in FIG. 1 is an exploded perspective view of a prior art core 8 shown with a section of wound carpet 10. The same core 8 is shown in side view in FIG. 1A. The core 8 is conventional in design, and generally consists of paper or plastic formed into a tubular shape. The carpet 10 typically is wound onto the core 8 and carried on the core 8 prior to sale as shown in FIG. 2. When carried in this fashion the overlap of the second layer 12 onto the first layer 14 (nearest the core 8) creates an undesirable crease or mark on the carpet 10 along the longitudinal area 16 where the second layer 12 overlaps the starting edge 18 of the first layer 14. FIG. 3 is a perspective view of a section of the carpet 10 showing the longitudinal crease 16. FIG. 4 is a cross sectional elevational view of the carpet 10 showing the crease 16 from a different perspective.

One current solution to this problem is to grind a indentation or step in the core where the starting edge of the carpet can be laid so that the starting edge is flush with the unground portion of the core and the second layer lays smoothly over the first layer. A disadvantage of this solution is that grinding the core requires machining, a process that creates a lot of dust.

Also, grinding a core with a big indentation or step for use with thicker floor coverings requires using a core having a larger wall thickness. For example, producing a core having 6 to 7 mm high step (compared to a more standard 2 to 3 mm high step) requires using a core having a wall thickness of at least 10 mm to ensure that the finished core will be stable.

The Present Invention

The present invention provides a core for use in the carpeting industry that eliminates the undesirable crease that can occur with conventional cores and does not require grinding of the core. FIG. 5 is an exploded perspective view of a core 28 according to the present invention shown with a section of wound carpet 30. The same core 28 is shown in side view in FIG. 5A. The core 28 is a hollow, wound paper tube having an integrally formed longitudinally oriented depression or indentation 32 that eliminates the longitudinal crease often found on the final few square meters of carpet 10 wound around a conventional core 8. The indentation 32 is configured to accommodate the starting edge 46 of the carpet material 30 as explained more fully below.

FIG. 6 is a side elevational view of the wound carpet 30 and core 28 of FIG. 5. FIG. 7 is an enlarged view of a portion of the wound carpet and core of FIG. 6. The core 28 has a length and a central axis (A), and is asymmetrical about the central axis (A). When viewed from the side as shown in FIGS. 5A, 6 and 7, the core 28 can be seen to be shaped like a closed non-circular cylinder, the cylinder comprising a single spiral having a first end 34 and a second end 36, with the ends 34, 36 being connected by a longitudinal segment or step 38. The step 38 has an inner facing surface 40 and an outer facing surface 42. The first end 34 of the spiral, i.e., the end closest to the central axis (A), has a first radius (R1), defined as the distance from the outer surface of the core 28 to the central axis (A). The second end 36 has a second, slightly larger radius (R2). The difference between the two radii (R2 minus R1) equals the height of the step 38.

As best shown in FIG. 7, the depth of the indentation 32 should be about the same as the thickness of the carpet 30 so that the second layer of carpet 30" lies smoothly over the first layer 30'. Viewed another way, the maximum depth of the indentation 32 is about the same as the height of the step 38. Viewed still another way, the depth of the indentation 32 is substantially the same as the difference between the second radius (R2) and the first radius (R1).

When a carpet 30 is carried on a core 28 made according to the present invention, the overlap of the second layer 30" onto the first layer 30' (nearest the core 28) is relatively smooth, with no undesirable crease or mark on the carpet 28 where the second layer 30" overlaps the starting edge 46 of the first layer 30'.

The core 28 may be thought of as being a deformed hollow tube, wherein the deformation is made by taking a hollow tubular structure having a circular cross section and applying a force along the length of the hollow tube to create the indentation 32, thereby creating a "folded" core.

As best shown in FIG. 7 the indentation 32 preferably has an asymmetrical cross section and is defined by a relatively gradual inwardly sloping first side 44 merging into a relatively steep inwardly sloping second side 42. The indentation 32 is configured to accommodate the starting portion of a carpet 30, with the bottom of the carpet 30 laying against the gradually sloping first side 44 and the carpet starting edge 46 facing the steep second side 42.

Figure 8:
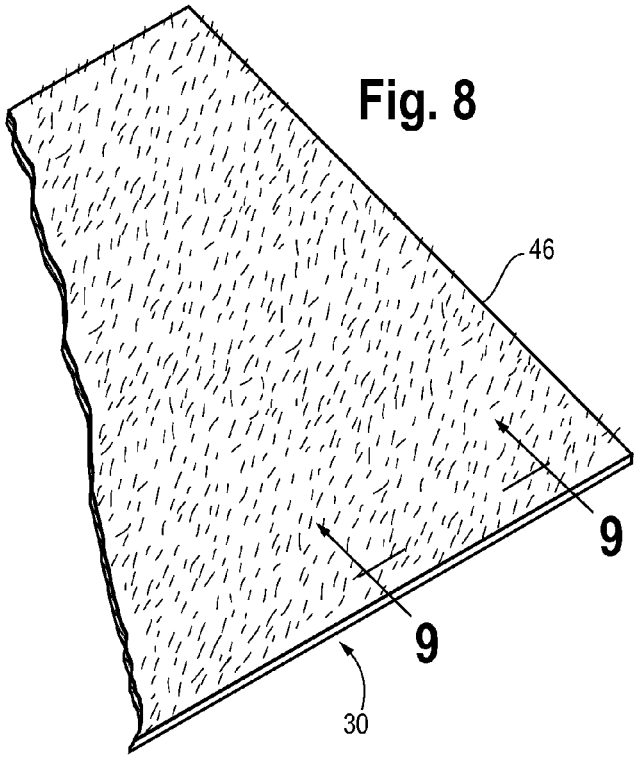
FIG. 8 is a perspective view of a section of the carpet of FIG. 5 shown laid flat.
Figure 9:
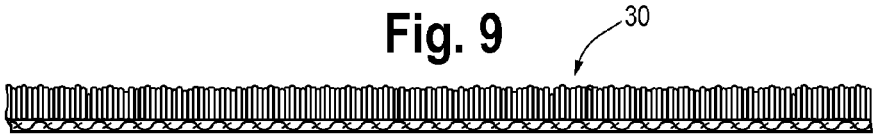
FIG. 9 is a cross sectional elevational view of the carpet of FIG. 7 taken along line 9-9.

When carried on a core 28 made according to the present invention the carpet 30 will have no longitudinal crease or mark when unwound. FIG. 8 is a perspective view of a section of the carpet 30 shown laid flat. FIG. 9 is a cross sectional elevational view of the carpet of FIG. 8 taken along line 9-9. The carpet 30 lacks the crease 16 of the carpet 10 of FIG. 3 which was wound around the prior art core 8.

The core 28 may be made according to the following steps:

(a) convolutely or spirally winding paper about a cylindrical mandrel to create a hollow tube;

(b) removing the hollow tube from the mandrel; and (c) forming in the hollow tube a longitudinally oriented indentation 32 extending uniformly along the length of the hollow tube, the indentation 32 having a longitudinally oriented concave shape adapted to accommodate the starting edge 46 of the carpet material 30.

Alternatively, the hollow tube may be made by an extrusion process using fiber based material, plastic, or any other suitable material in which an indentation can be formed, either during or after extrusion.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim as my invention:

1. A core for winding sheet material thereon, the sheet material having a starting edge, the core comprising:

a hollow tube having a length, inner and outer facing surfaces and a central axis, the inner and the outer facing surfaces of the tube being asymmetrical about the central axis, the tube comprising a longitudinally oriented indentation extending the length of the tube, the indentation being partly defined by a longitudinal step and having a longitudinally oriented substantially concave shape adapted to accommodate the starting edge of the sheet material;

wherein the core is shaped like a closed non-circular cylinder, the cylinder comprising a single spiral having a first end and a second end farther from the central axis than the first end, with the ends being connected by the longitudinal step, characterized in that the hollow tube is made of paper.

2. The core of claim 1 wherein the sheet material has a thickness and the indentation has a maximum depth substantially the same as the thickness of the sheet material.

3. The core of claim 2 wherein the indentation has an asymmetrical cross section and is defined by a relatively gradual inwardly sloping first side and a relatively steep inwardly sloping second side.

4. A core for winding sheet material thereon, the sheet material having a starting edge and a thickness, the core comprising a deformed hollow tube;

wherein the deformed tube has a length, inner and outer facing surfaces and a central axis, the inner and the outer facing surfaces of the deformed tube being asymmetrical about the central axis; and wherein the deformed hollow tube is made by taking a hollow tubular structure having a circular cross section and making a longitudinally oriented indentation extending uniformly along the length of the hollow tube, the indentation having an asymmetrical cross section and comprising a relatively gradual sloping first side connected to a relatively steep second side, the indentation having a maximum depth approximately equal to the thickness of the sheet material and adapted to accommodate the starting edge of the sheet material.

* * * * *